United States Patent [19]

Schwager et al.

[11] 4,067,385

[45] Jan. 10, 1978

[54] APPARATUS AND METHOD FOR CONNECTING A TUBING STRING TO DOWNHOLE WELL EQUIPMENT

[75] Inventors: Thomas E. Schwager; Joseph A. Burkhardt, both of New Orleans, La.

[73] Assignee: Exxon Production Research Company, Houston, Tex.

[21] Appl. No.: 727,738

[22] Filed: Sept. 29, 1976

[51] Int. Cl.[2] ..... E21B 33/035; E21B 33/122

[52] U.S. Cl. ..... 166/.6; 166/189; 166/313; 285/137 A

[58] Field of Search ..... 166/.6, 313, 189, 315; 24/249 PC, 249 DP; 285/137 R, 137 A

[56] References Cited

U.S. PATENT DOCUMENTS

| | | | |
|---|---|---|---|
| 3,012,608 | 12/1961 | McLaren, Jr. | 285/137 A |
| 3,324,983 | 6/1967 | Price | 166/.6 |
| 3,368,699 | 2/1968 | Scaggs | 24/249 DP |
| 3,934,648 | 1/1976 | Amancharla | 285/137 A |

*Primary Examiner*—James A. Leppink
*Attorney, Agent, or Firm*—John S. Schneider

[57] ABSTRACT

Apparatus is disclosed for tieing at least one tubing string suspended in a well pipe from a subsea non-rotatable christmas tree located on the sea floor to a downhole hanger affixed to the well pipe. The tubing string has a tie-back tool arranged on its lower end which contains first orienting means. The hanger contains second orienting means which is engageable with the first orienting means to position the tie-back tool in a desired angular position. Means arranged on the tubing string permit the tie-back tool to rotate to such angular position without placing torsional load on the tubing string. The method in which the tubing string is tied to the hanger is also disclosed.

10 Claims, 6 Drawing Figures

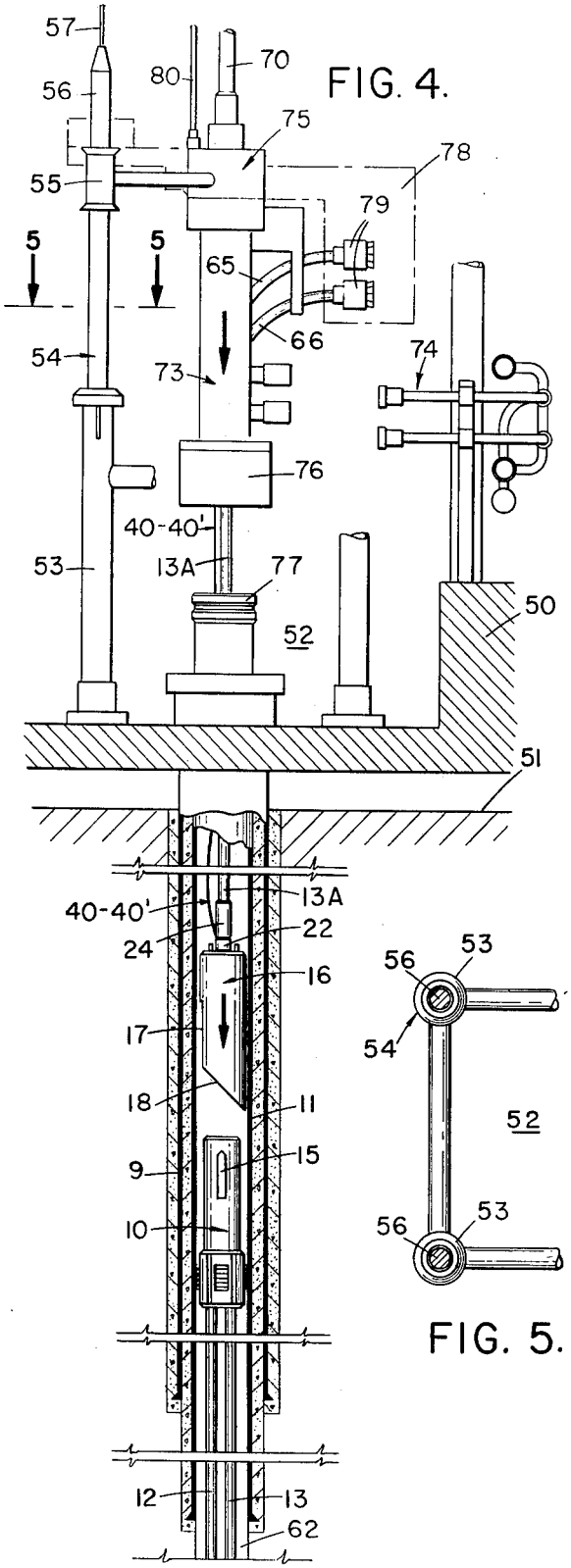
FIG. 4.
FIG. 5.
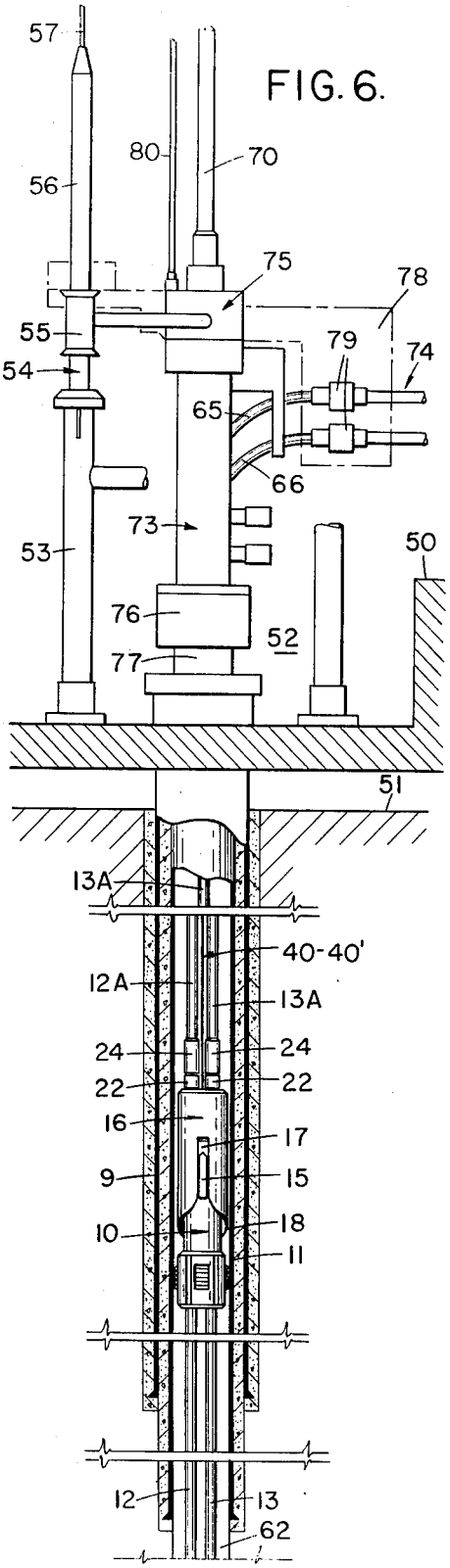
FIG. 6.

APPARATUS AND METHOD FOR CONNECTING A TUBING STRING TO DOWNHOLE WELL EQUIPMENT

BACKGROUND OF THE INVENTION

The present invention relates to apparatus for tieing a pipe to remote equipment and, more particularly, for tieing a well pipe to downhole well equipment such as a hanger or packer. In certain types of subsea well completions, such as the type described in U.S. Pat. No. 3,653,435 entitled "Multi-String Tubingless Completion Technique" by Reistle, III et al, dual tubing strings are tied back to a hanger which has dual bores therethrough and from which dual pipe strings are suspended. The hanger is located many feet, e.g. 100 to 600 or more feet, below a christmas tree positioned adjacent the sea floor. A tie-back tool, arranged on the lower ends of the tubing strings, contains orienting means which engages orienting means on the hanger to rotate the tie-back tool to a proper angular position at which the tubing strings are aligned with the bores in the hanger and with the pipe strings. However, when the tie-back tool rotates, the tubing strings to which the tie-back tool is attached are also rotated which torsionally loads the tubing strings and sufficient torque may not be available to complete rotation of the tie-back tool to its desired position.

The present invention eliminates such torsional loading in the tubing strings attached to the tie-back tool when connecting the tubing strings to the hanger.

SUMMARY OF THE INVENTION

In accordance with the teachings of the present invention apparatus is provided for tieing at least one tubing string suspended in a well pipe from a subsea non-rotatable christmas tree located on the sea floor to a downhole hanger affixed to the well pipe from which at least one other tubing string is suspended. The tubing string to be tied to the hanger has a tie-back tool arranged on its lower end which contains one part of a cam means (a cam surface or a cam key). The hanger contains a mating part of the cam means. When the cam means engage, the tie-back tool is positioned by the cam means in a desired rotational or angular position relative to the hanger. Non-torque means are arranged on the tubing string to permit the tie-back tool to rotate to such desired position without placing a torsional force on the tubing string. The present invention also contemplates a method for tieing a tubing string to a downhole hanger in which the tubing string is lowered to the hanger and the tie-back tool rotated to a proper angular position relative to the tubing string without torsionally loading the tubing string. The non-torque means may be positioned in the tie-back tool or in the christmas tree or located any place along the length of the tubing string. Further, such means is applicable to any size and number of tubing strings which have to be aligned in a predetermined orientation with respect to a subsurface hanger.

BRIEF DESCRIPTION OF THE DRAWINGS

FIGS. 4 and 6 illustrate lowering the tie-back tool of FIG. 1 in a well pipe and latching it to the hanger assembly; and FIG. 5 is a view taken along lines 5—5 of FIG. 4.

DESCRIPTION OF THE PREFERRED EMBODIMENTS

Figure 2:
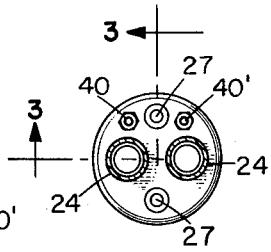
FIG. 2 is a view taken along lines 2—2 of FIG. 1.
Figure 1:
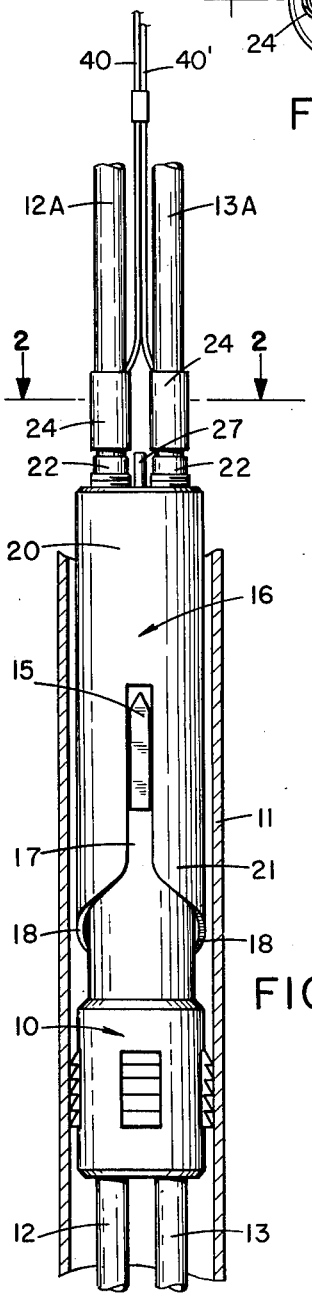
FIG. 1 is a side view of the tie-back tool connected to a hanger assembly in accordance with the invention.
Figure 3:
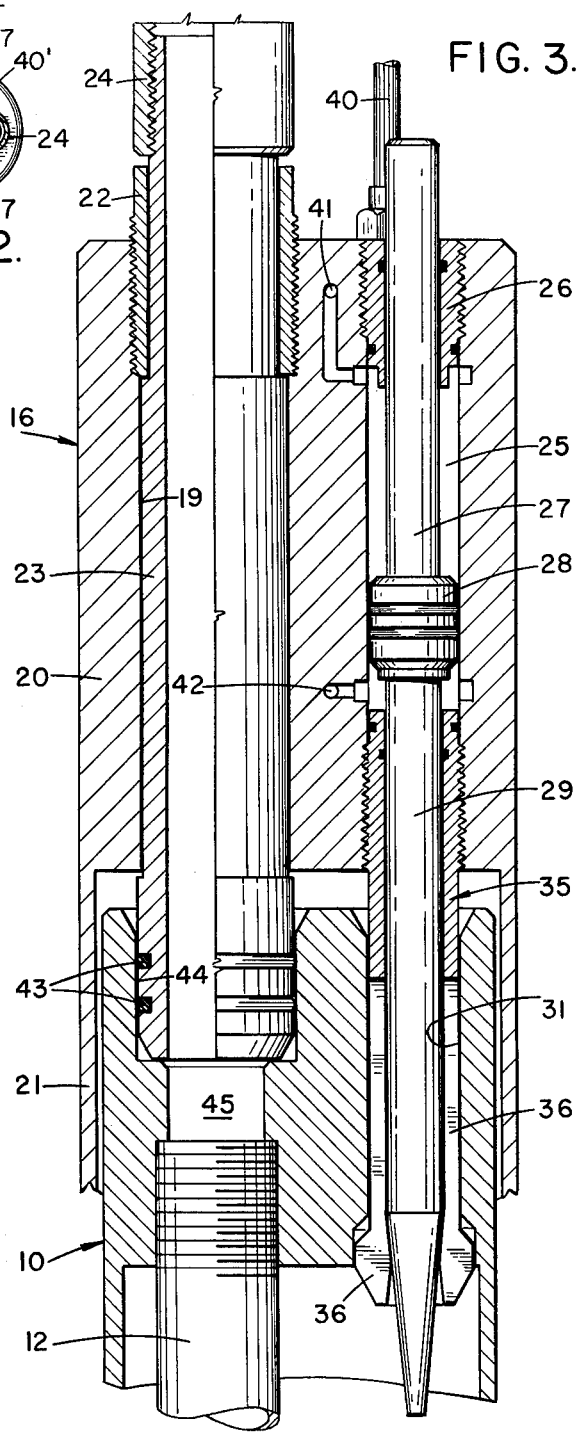
FIG. 3 is an enlarged partly sectional view of the tie-back tool and hanger assembly of FIG. 1 latched together.

There is shown in FIGS. 1-3 a hanger assembly 10 supported in a well pipe 11 from which are suspended parallel casing strings 12 and 13. Hanger assembly 10 contains a cam key 15 upon which has been guided a tie-back tool 16. A cam sleeve 21 formed on tie-back tool 16 contains a cam slot 17 and cam surfaces 18.

A housing portion 20 of tie-back tool 16 has two bores 19 therethrough into each of which is threaded a gland nipple 22. A rotatable nipple 23 is arranged in each bore 19. Nipples 23 extend through glands 22 and each connects to a coupling 24. One coupling 24 is connected to tubing string 12A and the other is connected to a tubing string 13A. Two piston chambers 25 are formed in housing 20 into the upper ends of which are threaded piston rod glands 26 through which the upper ends of upper piston rods 27 sealingly extend. Upper piston rods 27 are connected to pistons 28 which in turn are connected to lower piston rods 29 which sealingly extend through the upper ends of collets 35 threaded into the lower ends of piston chambers 25. Hanger assembly 10 contains bores 31 into which collets 35, and collet fingers 36 connected thereto, extend when tie-back tool 16 is properly guided and oriented onto hanger assembly 10. During such orientation pistons 28 are in their up positions as collets 35 and retracted collet fingers 36 are guided into bores 31. Hydraulic hoses 40 and 40' supply fluid pressure from the surface to chambers 25 through passages 41 and 42 to move pistons 28 downward and upward, respectively. The lower ends of nipples 23 are provided with O-ring seals 43 which engage the inner surfaces 44 of enlarged recesses 44 of bores 45 formed in hanger assembly 10. Casing pipe 12 is threaded into one bore 45 and casing pipe 13 is threaded into the other bore 45.

Referring to FIGS. 4, 5 and 6 an underwater platform or template 50 is positioned on the sea floor 51 and is provided with a well bay 52 with which is associated guide tubes 53 of a guide system 54. That system also includes guide funnels 55, guide posts 56 and cables 57 extending from the guide posts to the water's surface. The platform is installed by lowering it from a barge on cables. After the platform has been positioned a drilling vessel is moved in and positioned over well bay 52. After drilling boreholes and setting and cementing-in surface and casing pipe 9 and 11, as described in the aforementioned patent, a borehole 62 is drilled to a desired depth. Then, as also described in that patent, casing strings 12 and 13 suspended from a hanger assembly 10 are cemented in the well.

Tubing strings 12A and 13A are connected to christmas tree pipes 65 and 66, respectively, in a christmas tree 73. Pipes 65 and 66 are aligned with and then connected to manifold piping 74 supported on platform 50. A running tool 75 suspended on the lower end of a drill pipe 70 is connected to the upper end of christmas tree 73 which contains a wellhead connector 76 for connecting the christmas tree to a wellhead 77. Running tool 75 also includes a flowline connector 78 for connecting pipes 65 and 66 to manifold pipes 74 by means of connectors 79. A hose bundle 80 supplies hydraulic power to operate connector 78 and tie-back tool 16.

Christmas tree assembly 73, including flowline connector 78, is lowered from the drilling vessel on drill pipe 70 and guided into position by means of guide system 54. As the christmas tree assembly approaches its landing position cam surface 18 of tie-back tool 16 engages cam key 15 of hanger assembly 10 and causes housing 20 of tie-back tool 16 to rotate until slot 17 of sleeve 21 is aligned on cam key 15. Since the christmas tree and the upper ends of tubing strings 12A and 13A are fixed and are non-rotatable, housing 20 of tie-back tool 16 rotates about each nipple 23. Thus, the tie-back tool rotates the amount necessary to locate slot 17 on key 15 while nipples 23 are free to rotate relative to tie-back tool 16. The angular position of key 15 on hanger assembly 10 predetermines the amount of angular movement of tie-back tool 16. When key 15 is in slot 17 tubing strings 12A and 13A are aligned with casing strings 12 and 13. When tie-back tool 16 rotates dual strings 12A and 13A merely twist or wrap around themselves with little or no torsional load present. In the embodiment illustrated in FIGS. 4–6 tie-back tool 16 is cammed 90°. Neither of the tubing strings rotate. They merely twist around themselves. Tie-back tool 16 may be rotated as much as 180° in either direction depending upon the relative positions of key 15 and slot 17 as the tie-back tool is lowered onto the hanger assembly.

When tie-back tool 16 is properly oriented and aligned further lowering of it causes nipples 23 to engage enlarged recesses 44 in bores 45 of hanger assembly 10 and O-rings 43 engage and seal off the annuli between the inner surfaces of recesses 44 and the outer surfaces of nipples 23. Also, collet fingers 36 enter bores 31 in hanger assembly 10 as shown in FIG. 3. Hydraulic pressure is applied to chambers 25 above pistons 28 through hydraulic hose 40 and passages 41. Hydraulic fluid below pistons 28 is exhausted through passages 42 and hydraulic hose 40'. Pistons 28 are forced down to move lower piston rods 29 down through bores 31 and spread collet fingers 26 to latch tie-back tool 16 to hanger assembly 10. In that manner the lower ends of nipples 23 and O-rings 43 are maintained within bores 45 and the tie-back tool and nipples and tubing strings and hanger assembly act as a single torsionally rigid member.

When tie-back tool 16 is latched to hanger assembly 10 connector 76 on christmas tree assembly 73 is located adjacent wellhead 77 and only a short downward movement is required to connect connector 76 to wellhead 77. In this position of christmas tree assembly 73 connectors 79 are aligned with manifold pipes 74. The flow-line connection 78 is then operated to connect connectors 79 to manifold pipes 74.

The portion of housing 20 of tie-back tool 16 which contains nipples 23 and glands 22 may be installed separate from the tie-back tool itself. Such a housing may be located, for example, about 30 feet above the tie-back tool. It would be connected to and rotatable with the tie-back tool. Or such a housing may be located adjacent the christmas tree and either connected to the christmas tree or made integral with the christmas tree. When arranged in or connected to the christmas tree the housing would not rotate but instead would remain fixed and nipples 23 would rotate within the housing upon rotation of tie-back tool 16.

Changes and modifications may be made in the specific, illustrative embodiments of the invention shown and/or described herein without departing from the scope of the invention as defined in the appended claims.

Having fully described the method, apparatus, objects and advantages of our invention we claim:

1. Apparatus for tieing at least one tubing string suspended in a well pipe from a non-rotatable subsea christmas tree to a non-rotatable downhole hanger affixed to said well pipe comprising:

tool means arranged on the lower end of said tubing string containing first cam means, second cam means arranged on said hanger, said first and second cam means cooperating to orient said tool means to a predetermined angular position, and means arranged on said tubing string to permit said tool means to rotate without torsionally loading said tubing string, said means comprising a housing, a nipple arranged within said housing and connected to and rotatable with said tubing string, said tubing string and said nipple being rotatable relative to said housing upon rotation of said tool means.

2. Apparatus as recited in claim 1 in which said housing is connected to and rotatable with said tool means.

3. Apparatus as recited in claim 1 in which said housing is non-rotatable and connected to said non-rotatable christmas tree.

4. Apparatus as recited in claim 2 in which said housing forms part of said tool means.

5. Apparatus as recited in claim 4 in which said first cam means comprises cam surfaces and a slot and said second cam means comprises a key for engaging said cam surfaces and slot.

6. Apparatus for tieing two tubing strings suspended in a well pipe from a subsea non-rotatable christmas tree to a downhole hanger affixed to said well pipe, said downhole hanger having two vertical bores therethrough each of which connects to a well pipe string suspended from said hanger comprising:

a tie-back tool arranged on the lower ends of said tubing strings containing first cam means;

second cam means arranged on said hanger for engaging said first cam means, said first and second cam means when engaged cooperating to place said tie-back tool in a position at which said two tubing strings and said two bores in said hanger are aligned; and a housing connected to said tie-back tool having two bores through which said two tubing strings extend, each bore containing a nipple to permit said housing to rotate relative to said tubing strings.

7. Apparatus as recited in claim 6 in which said hanger contains first latching means and said tie-back tool contains second latching means, said first and second latching means cooperating to latch said tie-back tool to said hanger.

8. Apparatus as recited in claim 7 in which said first latching means comprises a bore in said hanger and said second latch means comprises collet fingers capable of passing through said first latching means and a piston rod capable of passing through said collet fingers to spread said collet fingers upon actuation of said piston rod.

9. Apparatus as recited in claim 6 in which said housing forms part of said tie-back tool.

10. A method for tieing back at least two tubing strings suspended in a well pipe from a non-rotatable subsea christmas tree to a downhole hanger fixed to said well pipe comprising the steps of:

lowering said plurality of tubing strings through said well pipe to said hanger, engaging first cam means provided on said downhole hanger with second cam means provided on tool means arranged on the lower ends of said tubing strings, and rotating said tool means to a selected angular position relative to said hanger and said tubing strings without torsionally loading said tubing strings.

* * * * *